US005611331A

United States Patent [19]

Phillips

[11] Patent Number: 5,611,331

[45] Date of Patent: Mar. 18, 1997

[54] FIREPLACE

[76] Inventor: Harry J. Phillips, 3622 Brandon St., Columbus, Ohio 43224

[21] Appl. No.: 616,447

[22] Filed: Mar. 15, 1996

Related U.S. Application Data

[63] Continuation-in-part of Ser. No. 321,905, Jan. 30, 1995, abandoned.

[51] Int. Cl.[6] ..... F24B 1/189

[52] U.S. Cl. ..... 126/539; 126/307 A; 126/523; 126/515; 126/531; 126/536

[58] Field of Search ..... 126/307 A, 512, 126/523, 536, 539, 515, 531, 533

[56] References Cited

U.S. PATENT DOCUMENTS 1,339,571 5/1920 Mersfelder .
1,943,213 10/1931 Dietz .
4,279,239 7/1981 Blum .
4,694,817 9/1987 Nilsson .

FOREIGN PATENT DOCUMENTS 2579300 3/1985 France .

*Primary Examiner*—Carl D. Price
*Attorney, Agent, or Firm*—Killworth, Gottman, Hagan & Schaeff

[57] ABSTRACT

A fireplace, comprising an inner jacket and an outer jacket defining an air circulation path therebetween, is provided with a smoke chamber convection wall and a baffle convection wall oriented so as to efficiently transfer heat from the fire box to the air circulation path. A damper plate and a back draft blocking wall are positioned in the fireplace so as to effectively block back drafts in both the open and closed damper positions. The fireplace also includes exterior controls whereby the damper plate and an outside air vent can be controlled in a safe manner. A clean out shaft and a draft control are also provided to facilitate safe operation of the fireplace.

17 Claims, 4 Drawing Sheets

FIREPLACE

CROSS REFERENCE TO RELATED APPLICATION

This application is a continuation-in-part of U.S. patent application Ser. No. 08/321,905, filed Jan. 30, 1995 now abandoned.

BACKGROUND OF THE INVENTION

The present invention relates to commercial and residential fireplaces. More particularly, it relates to a metal prefabricated fireplace.

Wood burning fireplaces are commonly used as primary or supplemental heating sources. The wood burning process creates noxious smoke which must be evacuated through a fireplace chimney located proximate the burning wood. A large amount of heat generated by the fire escapes through the chimney. The burning wood also creates a safety hazard for those operating the fireplace, building a fire, and/or extinguishing a fire.

Accordingly, there is a need for a fireplace which efficiently transfers heat from the fire box to the room in which the fireplace is disposed. Further, there is a need for a fireplace which ensures the safety of those operating the fireplace, building a fire, and/or extinguishing a fire.

SUMMARY OF THE INVENTION

This need is met by the present invention wherein a fireplace is provided including fire box and smoke chamber convection walls positioned to maximize heating efficiency. A fireplace is provided which may be operated with controls located on the exterior of the fireplace, away from any open flames. Finally, a fireplace is provided which is constructed with an energy efficient double jacket design incorporating a fire box clean out shaft.

In accordance with one embodiment the present invention, a fireplace is provided comprising an inner jacket including an upper portion and a lower portion, an outer jacket positioned relative to the inner jacket so as to define an air circulation path between the inner jacket and the outer jacket, an inner jacket floor portion and an outer jacket floor portion spaced apart so as to form a double floor portion defining an air circulation path between the inner jacket floor portion and the outer jacket floor portion, a clean out shaft provided in the double floor portion, a fire box defined by the lower portion of the inner jacket and including a fire box exhaust opening, a smoke chamber defined by the upper portion of the inner jacket and including a smoke chamber exhaust opening and an inclined smoke chamber convection wall extending from the fire box exhaust opening to the smoke chamber exhaust opening, a baffle portion formed in the inner jacket and including an inclined baffle convection wall extending from a rear wall of the fire box to the fire box exhaust opening and a back draft blocking wall extending from a rear wall of the smoke chamber to the fire box exhaust opening, a heated air output duct in communication with the air circulation path and extending across the fire box exhaust opening, a damper plate positioned relative to the fire box exhaust opening and coupled to an external damper handle and control arm so as to extend across the fire box exhaust opening in a closed position, to extend upwardly from the back draft blocking wall in an open position, and to lie outside of the downward projection of the smoke chamber exhaust opening in the open and closed positions, an outside air input vent provided in a rear wall of the outer jacket in communication with the fire box and coupled to an outside air vent handle and control arm so as to permit opening and closing of the outside air vent from the exterior of the fireplace, at least one fan positioned to circulate air from the exterior of the fireplace through the air circulation path and back to the exterior of the fireplace through the heated air output duct, two fire box doors positioned to form a front wall of the fire box, at least one of the doors including a door opening knob wherein the at least one door includes a latching assembly adapted to fix the doors in a closed position and adapted to permit opening of the doors by sliding the door opening knob in an upward direction, and a draft control including a series of input air holes provided in a front wall of the fire box and a slidable input air hole valve lever coupled to an air hole cover plate wherein a selectable amount of air is permitted to pass into the fire box by sliding the valve lever.

In accordance with another embodiment the present invention, a fireplace is provided comprising an inner jacket including an upper portion and a lower portion, an outer jacket positioned relative to the inner jacket so as to define an air circulation path between the inner jacket and the outer jacket, a fire box defined by the lower portion of the inner jacket and including a fire box exhaust opening and a baffle convection wall extending from a rear wall of the fire box to the fire box exhaust opening, a heated air output duct in communication with the air circulation path and extending across the fire box exhaust opening, and a smoke chamber defined by the upper portion of the inner jacket and including a smoke chamber exhaust opening and a smoke chamber convection wall, wherein substantially all of an upward projection of the fire box exhaust opening is intercepted by the smoke chamber convection wall.

The smoke chamber may further comprise a back draft blocking wall lying in a plane perpendicular to a downward projection of the smoke chamber exhaust opening and extending from a rear wall of the smoke chamber to the fire box exhaust opening. A damper plate may be positioned relative to the fire box exhaust opening so as to extend across the fire box exhaust opening in a closed position, to extend upwardly from the back draft blocking wall in an open position, and to lie outside of the downward projection of the smoke chamber exhaust opening in the open and closed position. The damper plate may be coupled to a external damper handle and control arm so as to permit selectable movement of the damper plate between the open and the closed positions. The damper handle and control arm may include damper plate positioning slots adapted to fix the damper plate in a variety of positions relative to the fire box exhaust opening.

The smoke chamber convection wall may comprise an inclined surface extending from the fire box exhaust opening to the smoke chamber exhaust opening. The baffle convection wall may comprise an inclined surface. The heated air output duct may comprise a series of hollow pipes.

An inner jacket floor portion and an outer jacket floor portion may be provided spaced apart so as to form a double floor portion defining an air circulation path between the inner jacket floor portion and the outer jacket floor portion. A clean out shaft may be provided in the double floor portion.

An outside air input vent is preferably provided in a rear wall of the outer jacket in communication with the fire box and is coupled to an outside air vent handle and control arm so as to permit opening and closing of the outside air vent from the exterior of the fireplace.

At least one fan may be positioned to circulate air from the exterior of the fireplace through the air circulation path and back to the exterior of the fireplace through heated air output vents. The at least one fan preferably comprises two fans positioned at a front portion of the fireplace.

Two fire box doors are preferably positioned to form a front wall of the fire box, at least one of the doors including a door opening knob wherein the at least one door includes a latching assembly adapted to fix the doors in a closed position and adapted to permit opening of the doors by sliding the door opening knob in an upward direction.

A draft control including a series of input air holes may be provided in a front wall of the fire box and a slidable input air hole valve lever may be coupled to an air hole cover plate wherein a selectable amount of air is permitted to pass into the fire box by sliding the valve lever.

In accordance with yet another embodiment the present invention, a fireplace is provided comprising an inner jacket including an upper portion and a lower portion, an outer jacket positioned relative to the inner jacket so as to define an air circulation path between the inner jacket and the outer jacket, a fire box defined by the lower portion of the inner jacket and including a fire box exhaust opening and a fire box convection wall extending from a rear wall of the fire box to the fire box exhaust opening, a smoke chamber defined by the upper portion of the inner jacket and including a smoke chamber exhaust opening and a smoke chamber convection wall extending from the fire box exhaust opening to the smoke chamber exhaust opening, wherein the fire box convection wall lies in a plane intersecting the smoke chamber convection wall.

Substantially all of an upward projection of the fire box exhaust opening is preferably intercepted by the smoke chamber convection wall and Substantially all of a downward projection of the smoke chamber exhaust opening is preferably intercepted by a back draft blocking wall.

A damper plate is preferably positioned relative to the fire box exhaust opening so as to extend across the fire box exhaust opening in a closed position, to extend upwardly from a back draft blocking wall in an open position, and to lie outside of the downward projection of the smoke chamber exhaust opening in the open and the closed positions.

The smoke chamber may further comprise a back draft blocking wall lying in a plane perpendicular to a downward projection of the smoke chamber exhaust opening and extending from a rear wall of the smoke chamber to the fire box exhaust opening.

Accordingly it is an object of the present invention to provide a high efficiency fireplace. It is a further object of the present invention to provide a fireplace which may be operated in a safe and convenient manner. Finally, it is an object of the present invention to provide a fireplace which effectively blocks back drafts.

DETAILED DESCRIPTION OF THE INVENTION

Figure 1:
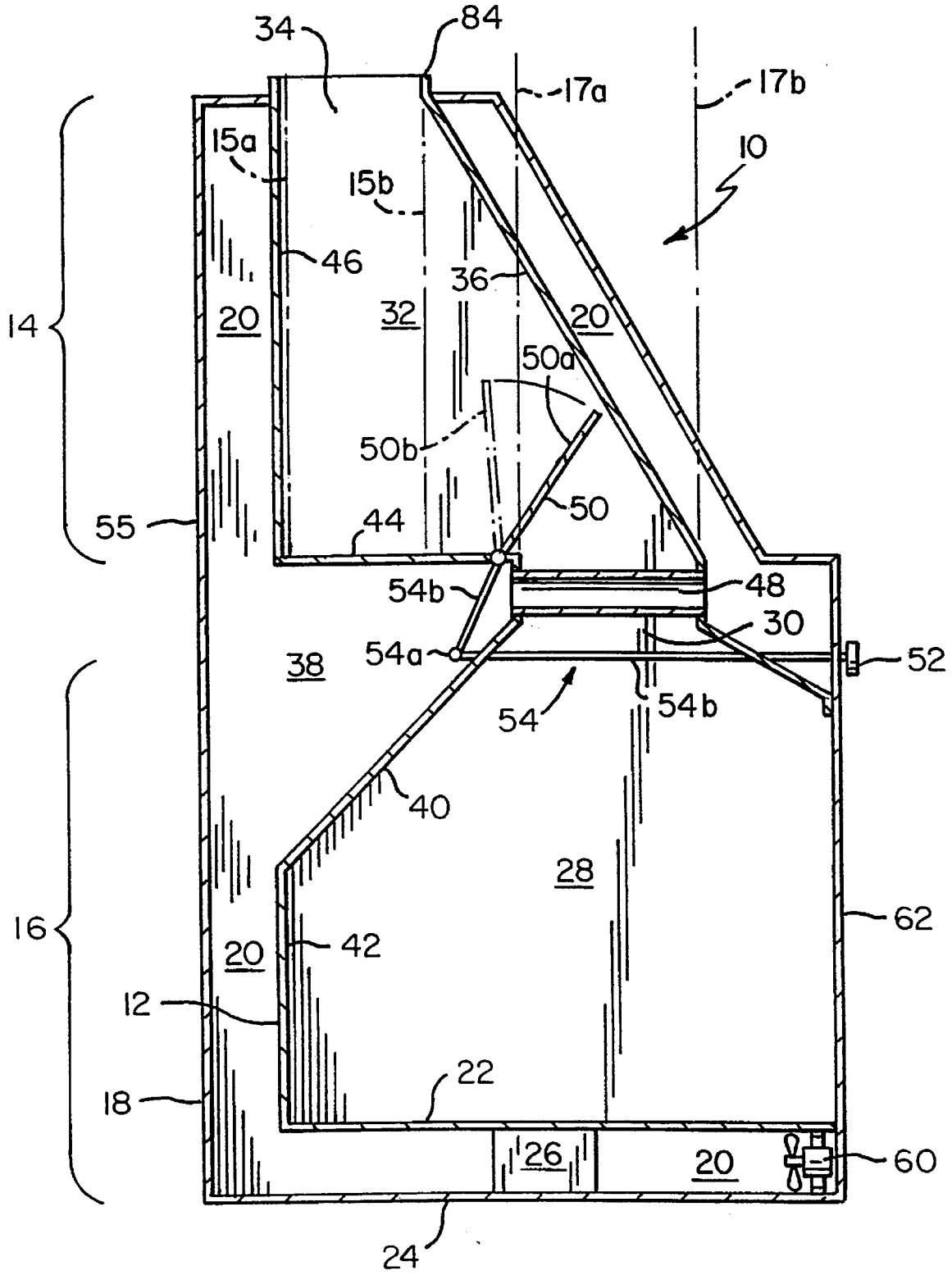
FIG. 1 is a side view, in cross section, of a fireplace according to the present invention.

The present invention will be described with reference to FIGS. 1–4B. The fireplace 10 of the present invention is provided with a metallic inner jacket 12 including an upper portion 14 and a lower portion 16. A metallic outer jacket 18 is fixedly defined by a spaced relationship from the inner jacket 12 so as to define an air circulation path 20 between the inner jacket and the outer jacket. The inner jacket 12 and the outer jacket 18 are welded together at mutual support points throughout the body of the fireplace 10, as can be appreciated by one of ordinary skill in the art. The metallic inner jacket 12 and the metallic outer jacket 18 preferably comprise steel but may also comprise cast iron or another suitable metal. As described below, the air circulation path 20 provides for efficient transfer of heat from the inner jacket 12 to the air circulation path 20 and the exterior of the fireplace 10.

An inner jacket floor portion 22 and an outer jacket floor portion 24 are spaced apart so as to form a double floor forming a portion of the air circulation path 20 between the inner jacket floor portion 22 and the outer jacket floor portion 24. In this manner, heat generated in the inner jacket floor portion 22 may be transferred to the air circulation path 20 and through air passages 21 formed in an inner jacket support member 23. A fire box clean out shaft 26, shaft cover plate 26*a*, a cover plate control arm assembly 26*b*, and an exterior cover plate control knob 26*c* are provided in the double floor portion to facilitate safe and convenient maintenance of the fireplace 10. Push-pull operation of the cover plate control knob 26*c* opens and closes the cover plate to facilitate safe and convenient removal of fire box waste through the clean out shaft 26.

A fire box 28 is defined by the lower portion 16 of the inner jacket 12 and includes a fire box exhaust opening 30. A smoke chamber 32 is defined by the upper portion 14 of the inner jacket 12 and includes a smoke chamber exhaust opening 34 and an inclined smoke chamber convection wall 36 extending from the fire box exhaust opening 30 to the smoke chamber exhaust opening 34. It is contemplated by the present invention that the fire box 28 may accommodate a burning wood heat source, a natural gas heat source, or a bottled gas heat source.

A baffle 38 is formed in the inner jacket 12 and includes an inclined baffle convection wall 40 extending from a rear wall 42 of the fire box 28 to the fire box exhaust opening 30 and a back draft blocking wall 44 extending from a rear wall 46 of the smoke chamber 32 to the fire box exhaust opening 30. A heated air output duct 48 is provided in communication with the air circulation path 20 and extending across the fire box exhaust opening 30. A damper plate 50 is positioned relative to the fire box exhaust opening 30 and is coupled to an exterior damper handle 52 and control arm 54 so as to permit extension of the damper plate 50 across the fire box exhaust opening 30 in a closed position 50*a*, to extend upwardly from the back draft blocking wall 44 in an open position 50*b*, and to lie outside of. i.e., avoid intersection with, a downward projection, see reference lines 15*a* and 15*b* in FIG. 1, of the smoke chamber exhaust opening 34 in the open and closed positions 50*a*, 50*b*. The downward projection of the smoke chamber exhaust opening is defined by the size and shape of the opening boundaries projected from the top of the fireplace 10 towards the bottom of the fireplace 10.

Figure 2:
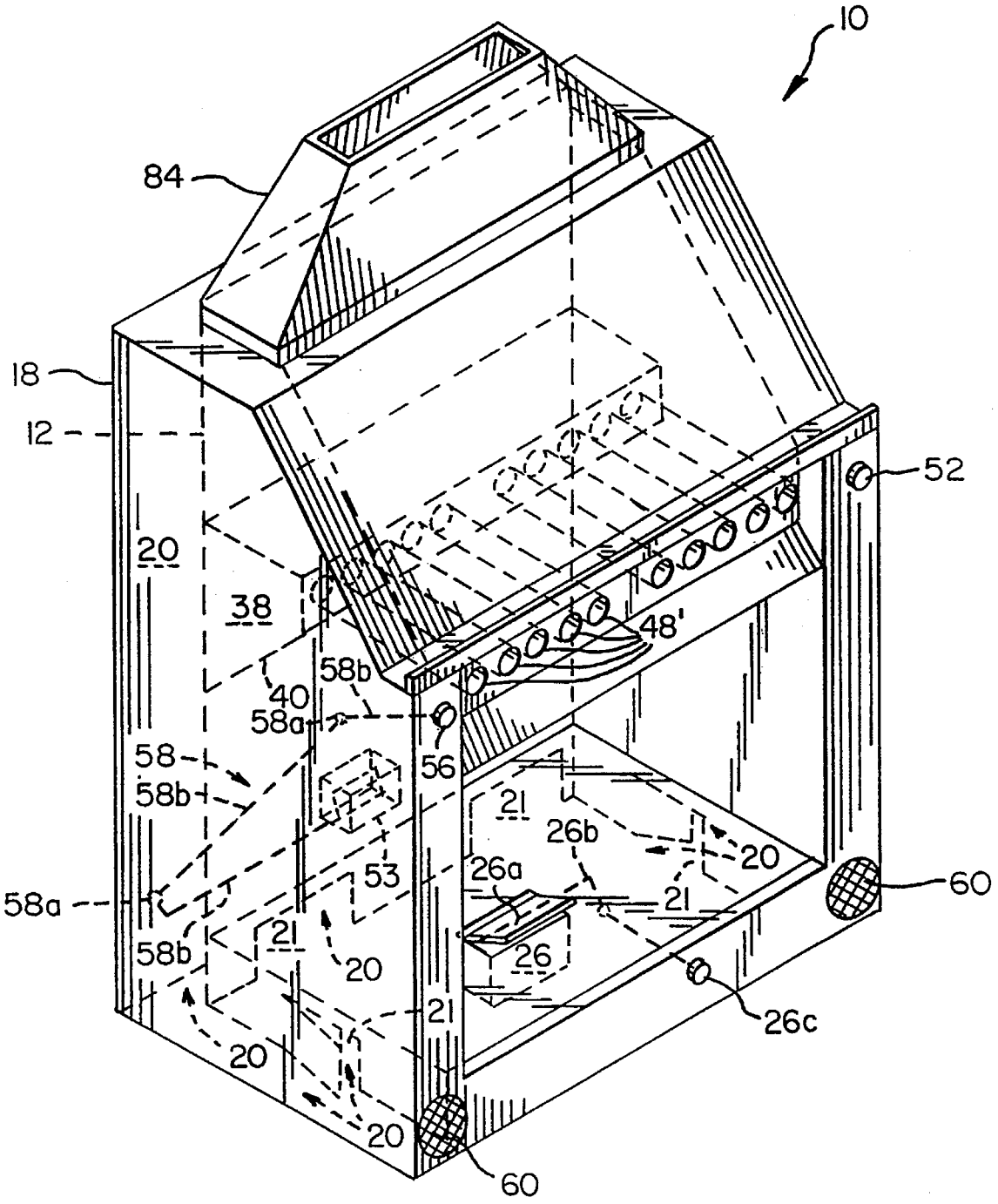
FIG. 2 is a perspective view of a fireplace according to the present invention.

Two circulating fans 60 are positioned to circulate air from the exterior of the fireplace through the air circulation path 20 and back to the exterior of the fireplace through the heated air output duct 48. As FIG. 2 illustrates, the heated air output duct 48 preferably comprises a series of hollow pipes 48'. It is contemplated by the present invention that the fans may be controlled by a thermostat provided in the vicinity of the fireplace 10, in contact with the outer jacket 18, or in the air circulation path 20.

The design of the inner jacket 12 is such that an upward projection, see reference lines 17*a* and 17*b* in FIG. 1, of the fire box exhaust opening 30 is intercepted by the smoke chamber convection wall 36. As a result, heat escaping through the fire box exhaust opening 30 will transfer to the surface of the smoke chamber convection wall 36 and will subsequently be transferred to the remainder of the inner jacket 12, the air in air circulation path 20, and, finally, to the exterior of the fireplace through the heated air duct 48. Additionally, heat passing through the fire box exhaust opening 30 will also be transferred to the surface of the heated air output duct 48 and subsequently be transferred to the air passing through the heated air output ducts 48. The inclined baffle convection wall 40 also acts as an efficient heat transfer surface by receiving heat from the fire box 28 and transferring the heat to the remainder of the inner jacket 12, the air in air circulation path 20, and, finally, to the exterior of the fireplace through the heated air duct 48. The inclination of the smoke chamber convection wall 36 and the baffle convection wall 40 provides efficient heat transfer surfaces while permitting noxious smoke to pass out of the fireplace 10 through a flue 84. In this manner, a plurality of heat transfer surfaces are provided in the fireplace 10 to create an efficient transfer of heat from the firebox 28 to the exterior of the fireplace 10.

The design of the inner jacket 12 is such that a downward projection of the smoke chamber exhaust opening 34 is intercepted by, and perpendicular to, the back draft blocking wall 44. As a result, a back draft moving down the flue 84, towards the fire box 28, will be blocked by the back draft blocking wall 44 and further diverted back up the flue 84 by the damper plate 50. Because the entire damper plate 50 lies outside of the downward projection of the smoke chamber exhaust opening 30 in both the open and closed damper positions 50*a*, 50*b*, a back draft will be contained by the combination of the back draft blocking wall 44 and the damper plate 50 and will not be permitted to pass directly into the fire box 28. As a result, noxious smoke is prevented from being forced back into the fire box 28 in the event of a back draft produced, for example, by high winds at the top of the flue 84.

The mechanical coupling of the exterior damper handle 52 and control arm 54 to the damper 50, as illustrated in FIG. 1, includes a joint 54*a* and rigid rods 54*b* arranged such that push-pull movement of the exterior damper handle 52 will open and close the damper plate 50. The joint 54*a* may comprise any well known rigid metal bar joint arrangement, e.g., a circular cross section shaft joining the two rigid rods 54*b* in a hinged relationship and secured by a cotter pin. The mechanical coupling of the damper plate 50 to the external damper handle 52 permit selectable movement of the damper plate 50 between the open and the closed positions 50*a*, 50*b*. The control arm 54*b* includes damper plate positioning slots which are adapted to engage the fireplace 10 so as to fix the damper plate 50 and control arm 54*b* in a variety of positions relative to the fire box exhaust opening 30.

An outside air input vent 53, illustrated in FIG. 2, is provided in a rear wall 55 of the outer jacket 18 in communication with the fire box 28 for providing a combustion air supply to the fire box 28 and is mechanically coupled to an outside air vent handle 56 and control arm 58 so as to permit opening and closing of the outside air vent 53 from the exterior of the fireplace 10. The mechanical coupling of the outside air vent handle 56 and control arm 58 to the vent 53 includes joints 58*a* and rigid rods 58*b* arranged such that push-pull movement of the air vent handle will open and close the air vent. The joints 58*a* may comprise any well known rigid metal bar joint arrangement, e.g., a circular cross section shaft joining two rigid rods 58*b* in a hinged relationship and secured by a cotter pin.

Figure 3:
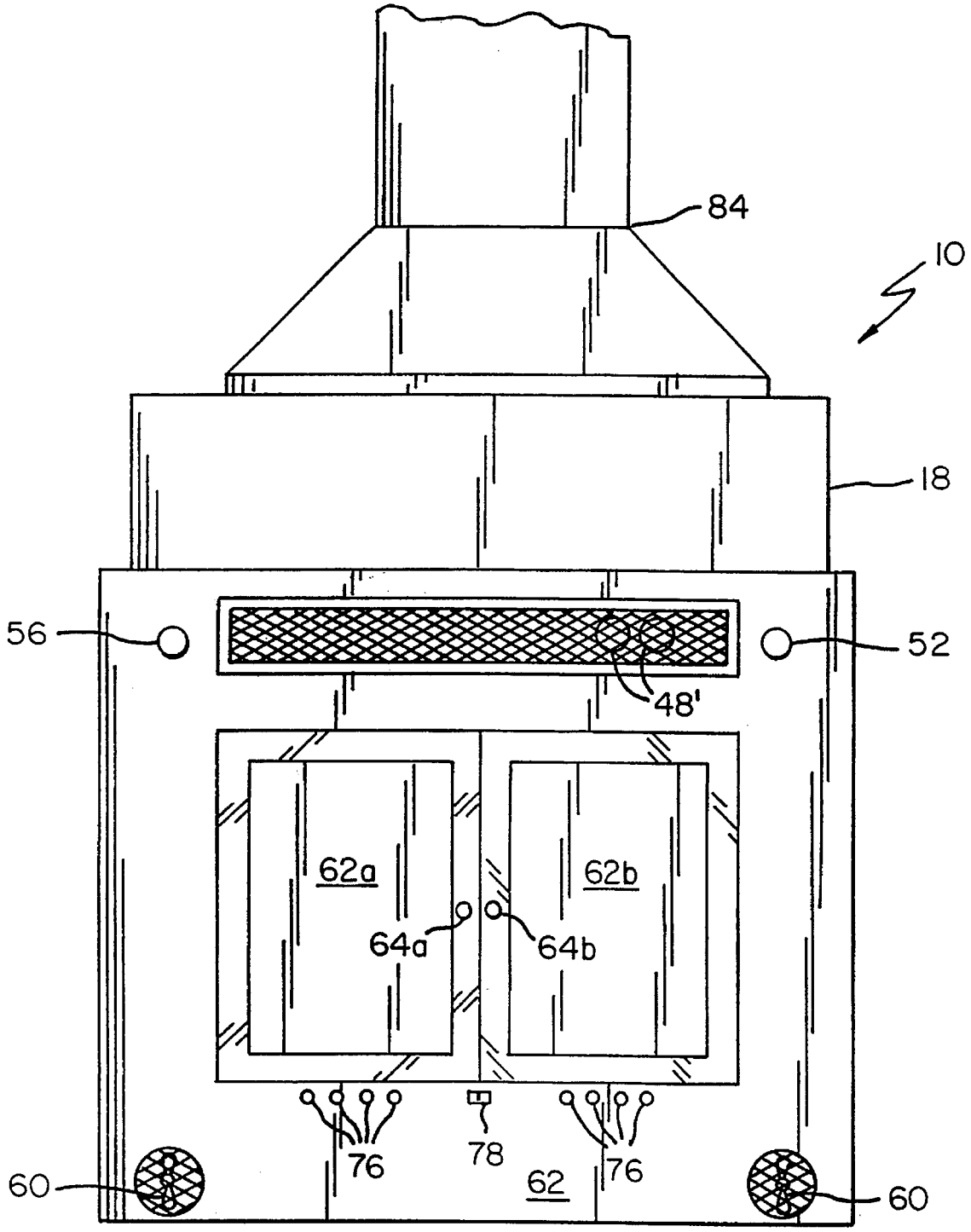
FIG. 3 is a front view of a fireplace according to the present invention.
Figure 4B:
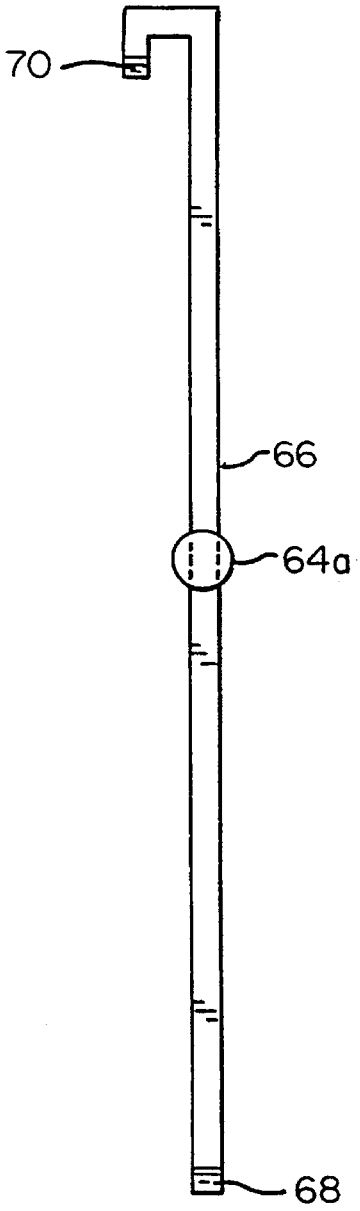
FIG. 4A is a side view of fireplace hardware provided in the vicinity of the face of a fireplace according to the present invention; and, FIG. 4B is a front view of a portion of the fireplace hardware shown in FIG. 4A.
Figure 4A:
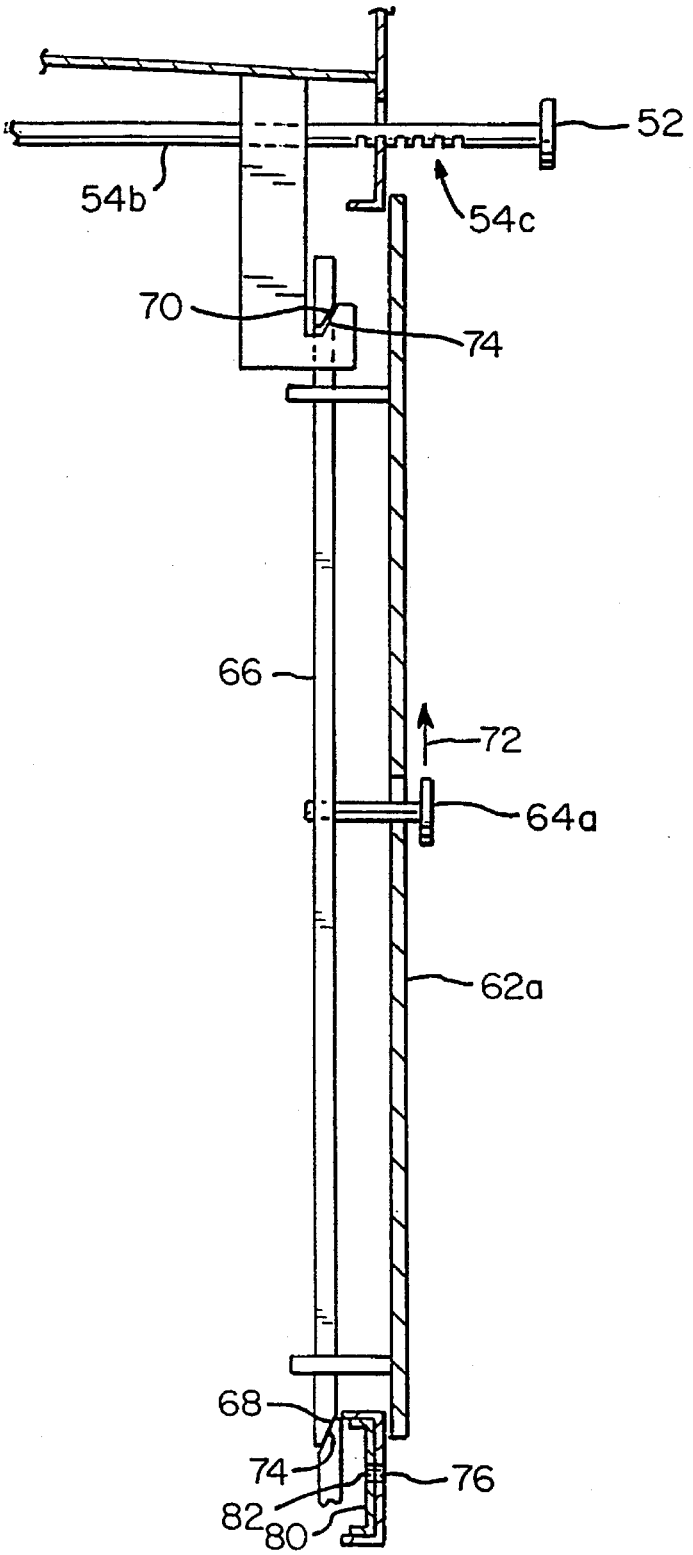

Two fire box doors 62*a*, 62*b* are positioned to form a portion of a front wall 62 of the fire box 28, as illustrated in FIG. 3. The doors 62*a*, 62*b* include door opening knobs 64*a*, 64*b*. A latching assembly, illustrated in FIGS. 4A and 4B is coupled to each door opening knob 64*a*, 64*b* and is adapted to fix the doors 62*a*, 62*b* in a closed position and to permit opening of the doors 62*a*, 62*b* by sliding the door opening knob in an upward direction. Each door opening knob 64*a*, 64*b* is coupled to a vertically oriented J-bar 66 with an upper wedge portion 70 and a lower wedge portion 68, see FIGS. 4A and 4B. The upper wedge portion 70 and the lower wedge portion 68 hold the door 62*a*, 62*b* in a closed position when engaged in wedge seating members 74. Movement of either knob 64*a*, 64*b* in an upward direction 72 disengages the wedge portions 68, 70 from the respective wedge seating members 74 and permits opening of the corresponding door 62*a*, 62*b*. It is contemplated by the present invention that only one of the doors 62*a*, 62*b* may include the latching assembly described above provided the door including the latching assembly is capable of holding the door without the latching assembly in a closed position. It is further contemplated by the present invention that commercially available magnetic door latches may be substituted for the door latching assembly described above without departing from the scope of the present invention.

FIGS. 3 and 4B illustrate a draft control including a series of input air holes 76 provided in a front wall 62 of the fire box 28. A slidable air hole valve lever 78 is coupled to an air hole cover plate 80 including a series of cover plate air holes 82 having size and positions corresponding to the input air holes 76. A selectable amount of air is permitted to pass into the fire box 28 by sliding the valve lever so as to change the alignment of the input air holes 76 and the cover plate air holes 82. When the input air holes 76 and the cover plate air holes 82 are coaxially aligned, a maximum amount of air is permitted to pass into the fire box 28. When the input air holes 76 and the cover plate air holes 82 are completely out of alignment, a minimum amount of air is permitted to pass into the fire box 28 because the input air holes 76 are effectively blocked by a portion of the cover plate 80 not including the cover plate air holes 82.

Having described the invention in detail and by reference to preferred embodiments thereof, it will be apparent that modifications and variations are possible without departing from the scope of the invention defined in the appended claims.

What is claimed is:

1. A fireplace comprising:

an inner jacket having walls defining an inner jacket volume, said inner jacket including an upper portion and a lower portion;

an outer jacket having walls positioned relative to said inner jacket so as to define an air circulation path between said inner jacket and said outer jacket;

an inner jacket floor portion and an outer jacket floor portion spaced apart so as to form a double floor portion;

a clean out shaft provided in said double floor portion including a clean out shaft cover plate, a cover plate control arm assembly, and an exterior cover plate control knob;

a fire box defined by said lower portion of said inner jacket and including a fire box exhaust opening;

a smoke chamber defined by said upper portion of said inner jacket and including a smoke chamber exhaust opening and an inclined smoke chamber convection wall extending from said fire box exhaust opening to said smoke chamber exhaust opening;

a baffle portion formed in said inner jacket and including an inclined baffle convection wall extending from a rear wall of said fire box to said fire box exhaust opening and a back draft blocking wall extending from a rear wall of said smoke chamber to said fire box exhaust opening;

a heated air output duct in communication with said air circulation path and extending across said fire box exhaust opening;

a damper plate positioned relative to said fire box exhaust opening and coupled to a external damper handle and control arm so as to extend across said fire box exhaust opening in a closed position, to extend upwardly from said back draft blocking wall in an open position, and to lie outside of a downward projection of said smoke chamber exhaust opening in the open and closed positions;

an outside air input vent provided in a rear wall of said outer jacket in communication with said fire box and coupled to an outside air vent handle and control arm so as to permit opening and closing of said outside air vent from the exterior of said fireplace;

at least one fan positioned to circulate air from the exterior of the fireplace through said air circulation path and back to the exterior of the fireplace through said heated air output duct;

two fire box doors positioned to form a front wall of the fire box, at least one of said doors including a door opening knob wherein said at least one door includes a latching assembly adapted to fix the doors in a closed position and adapted to permit opening of the doors by sliding the door opening knob in an upward direction; and, a draft control including a series of input air holes provided in a front wall of said fire box and a slidable input air hole valve lever coupled to an air hole cover plate wherein a selectable amount of air is permitted to pass into the fire box by sliding said valve lever.

2. A fireplace comprising:

an inner jacket having walls defining an inner jacket volume, said inner jacket including an upper portion and a lower portion;

an outer jacket having walls positioned relative to said inner jacket so as to define an air circulation path between said inner jacket and said outer jacket;

a fire box defined by said lower portion of said inner jacket and including a fire box exhaust opening and a fire box convection wall extending from a rear wall of the fire box to said fire box exhaust opening;

a smoke chamber defined by said upper portion of said inner jacket and including a smoke chamber exhaust opening and a smoke chamber convection wall extending from said fire box exhaust opening to said smoke chamber exhaust opening, wherein the fire box convection wall lies in a plane intersecting said smoke chamber convection wall; and a damper plate positioned relative to said fire box exhaust opening so as to extend across said fire box exhaust opening in a closed position, to extend upwardly from a back draft blocking wall in an open position, and to lie outside of the downward projection of said smoke chamber exhaust opening in the open and the closed positions.

3. A fireplace as claimed in claim 2 wherein substantially all of an upward projection of said fire box exhaust opening is intercepted by said smoke chamber convection wall and wherein substantially all of a downward projection of said smoke chamber exhaust opening is intercepted by a back draft blocking wall.

4. A fireplace as claimed in claim 2 wherein said smoke chamber further comprises a back draft blocking wall lying in a plane perpendicular to a downward projection of said smoke chamber exhaust opening and extending from a rear wall of said smoke chamber to said fire box exhaust opening.

5. A fireplace comprising:

an inner jacket having walls defining an inner jacket volume, said inner jacket including an upper portion and a lower portion;

an outer jacket having walls positioned relative to said inner jacket so as to define an air circulation path between said inner jacket and said outer jacket;

a fire box defined by said lower portion of said inner jacket and including a fire box exhaust opening and a baffle convection wall extending from a rear wall of said fire box to said fire box exhaust opening;

a heated air output duct in communication with said air circulation path and extending across said fire box exhaust opening;

a smoke chamber defined by said upper portion of said inner jacket and including a smoke chamber exhaust opening and a smoke chamber convection wall, wherein substantially all of an upward projection of said fire box exhaust opening is intercepted by said smoke chamber convection wall;

a back draft blocking wall lying in a plane perpendicular to a downward projection of said smoke chamber exhaust opening and extending from a rear wall of said smoke chamber to said fire box exhaust opening; and a damper plate positioned relative to said fire box exhaust opening so as to extend across said fire box exhaust opening in a closed position, to extend upwardly from said back draft blocking wall in an open position, and to lie outside of the downward projection of said smoke chamber exhaust opening in the open closed position.

6. A fireplace as claimed in claim 2 wherein said damper plate is coupled to a external damper handle and control arm so as to permit selectable movement of the damper plate between the open and the closed positions.

7. A fireplace as claimed in claim 6 wherein said damper handle and control arm include damper plate positioning slots adapted to fix the damper plate in a variety of positions relative to said fire box exhaust opening.

8. A fireplace as claimed in claim 5 wherein said smoke chamber convection wall comprises an inclined surface extending from said fire box exhaust opening to said smoke chamber exhaust opening.

9. A fireplace as claimed in claim 5 wherein said baffle convection wall comprises an inclined surface.

10. A fireplace as claimed in claim 5 wherein said heated air output duct comprises a series of hollow pipes.

11. A fireplace as claimed in claim 5 wherein an inner jacket floor portion and an outer jacket floor portion are spaced apart so as to form a double floor portion defining an air circulation path between said inner jacket floor portion and said outer jacket floor portion.

12. A fireplace as claimed in claim 5 wherein a clean out shaft is provided in said double floor portion.

13. A fireplace as claimed in claim 5 wherein an outside air input vent is provided in a rear wall of said outer jacket in communication with said fire box path and is coupled to an outside air vent handle and control arm so as to permit opening and closing of said outside air vent from the exterior of said fireplace.

14. A fireplace as claimed in claim 5 further comprising at least one fan positioned to circulate air from the exterior of the fireplace through said air circulation path and back to the exterior of the fireplace through heated air output vents.

15. A fireplace as claimed in claim 14 wherein said at least one fan comprises two fans positioned at a front portion of said fireplace.

16. A fireplace as claimed in claim 5 further comprising two fire box doors positioned to form a front wall of the fire box, at least one of said doors including a door opening knob wherein said at least one door includes a latching assembly adapted to fix the doors in a closed position and adapted to permit opening of the doors by sliding the door opening knob in an upward direction.

17. A fireplace as claimed in claim 5 further comprising a draft control including a series of input air holes provided in a front wall of said fire box and a slidable input air hole valve lever coupled to an air hole cover plate wherein a selectable amount of air is permitted to pass into the fire box by sliding said valve lever.

* * * * *